US007112249B2

(12) United States Patent
Schroth et al.

(10) Patent No.: US 7,112,249 B2
(45) Date of Patent: Sep. 26, 2006

(54) HOT BLOW FORMING CONTROL METHOD

(75) Inventors: James Gregory Schroth, Troy, MI (US); Mark W. Verbrugge, Troy, MI (US); John Robert Bradley, Clarkston, MI (US)

(73) Assignee: General Motors Corporation, Detroit, MI (US)

( * ) Notice: Subject to any disclaimer, the term of this patent is extended or adjusted under 35 U.S.C. 154(b) by 404 days.

(21) Appl. No.: 10/674,947

(22) Filed: Sep. 30, 2003

(65) Prior Publication Data

US 2005/0067063 A1 Mar. 31, 2005

(51) Int. Cl.
*C21D 11/00* (2006.01)
*C22F 1/04* (2006.01)

(52) U.S. Cl. ..... 148/511; 72/57

(58) Field of Classification Search ..... 148/511, 148/564; 72/57, 297, 60
See application file for complete search history.

(56) References Cited

U.S. PATENT DOCUMENTS

| | | | | |
|---|---|---|---|---|
| 5,689,987 | A * | 11/1997 | Yasui | 72/60 |
| 5,737,954 | A * | 4/1998 | Yasui | 72/60 |
| 5,974,847 | A * | 11/1999 | Saunders et al. | 72/57 |
| 6,253,588 | B1 * | 7/2001 | Rashid et al. | 72/57 |
| 6,810,709 | B1 * | 11/2004 | Hammar et al. | 72/342.7 |
| 6,880,377 | B1 * | 4/2005 | Kim et al. | 72/57 |
| 6,907,761 | B1 * | 6/2005 | Spence et al. | 72/60 |
| 6,910,358 | B1 * | 6/2005 | Schroth | 72/57 |
| 2003/0000275 | A1 * | 1/2003 | Spence et al. | 72/342.1 |

* cited by examiner

*Primary Examiner*—Scott Kastler
(74) *Attorney, Agent, or Firm*—Kathryn A. Marra

(57) ABSTRACT

A sheet material is gripped at its edges and hot blow formed by a pressurized working gas against a forming tool surface. The flow characteristics of the material are determined at increasing gas pressures over a range of temperature relevant to the forming operation. A predetermined pressure/time schedule is determined at a reference temperature for rapid shape formation of good parts on a continual basis. The process is then controlled as parts are thus formed by measuring the forming temperature of the parts and correcting the pressure time schedule, using the determined flow characteristics, for the actual temperature to achieve the desired shape evolution of the parts.

10 Claims, 2 Drawing Sheets

HOT BLOW FORMING CONTROL METHOD

TECHNICAL FIELD

This invention pertains to hot blow forming of a sheet material against a forming tool surface using a pressurized working gas to stretch the sheet. More specifically, this invention pertains to a method of controlling the pressure of the working gas in response to a measured temperature, such as the temperature of the forming tool surface, that influences the strain rate of material flow.

BACKGROUND OF THE INVENTION

In blow forming, a sheet of formable material is heated to a temperature at which it can be stretched by a pressurized working gas against a heated forming surface. The hot sheet material is gripped at its edges adjacent to the mold or die surface and pressurized air, or other suitable working gas, is applied to one side of the sheet to push and stretch the other side into conformance with the forming surface. The sheet is thus permanently deformed and the gas is vented and the formed sheet product removed from the mold or die. The sheet material may, for example, be a suitable metal alloy, a synthetic polymer or the like.

Hot blow forming processes are used to form automotive body panels using an aluminum alloy, such as fine grained AA5083, in cold rolled and recrystallized sheet form. For example, the Rashid et al. U.S. Pat. No. 6,253,588, Quick Plastic Forming of Aluminum Alloy Sheet Metal, assigned to the assignee of this invention, describes such a process. The aluminum alloy sheet blank is heated to a suitable temperature in the range of about 400° C. to about 510° C. and stretched under the pressure of a working gas into conformance with the surface of a forming tool. The gas pressure is increased in a predetermined controlled pressure-time sequence (e.g., in stepwise increments) from ambient pressure to a final level in the range of about 250 psi to about 500 psi or higher. The strategy is to strain and shape the sheet metal as rapidly as possible without tearing or cracking it. However, the pressure application rate has necessarily been conservative because the workpiece heating mechanisms have not necessarily yielded precise temperature control from hour to hour or from workpiece to workpiece in continuous sheet metal forming operations.

Forming tools are often made of steel and are massive heat sinks. The tools may be heated by electrical resistance heating rods in a control circuit. When the tools are to be maintained at high temperatures, such as 400° C. to 500° C., effective maintenance of the target tool temperature often depends on balancing electric power input with the opening and closing of the tools to the ambient temperature on a regular time pattern. But in actual practice the temperature of the tools can vary by several degrees from a target temperature for many reasons. Restoring the actual temperature of a massive tool to a target temperature may require some time during which it is usually desired to continue efficient production of good parts on the tool.

It is an object of this invention to provide an improved method of coordinating working gas pressure application and sheet material flow behavior with actual forming tool temperature to improve the productivity of hot blow forming tooling while maintaining the quality of the formed sheet metal panel or other product.

SUMMARY OF THE INVENTION

The practice of the invention will be illustrated with reference to the forming of a superplastically formable AA5083 sheet metal material. However, the method can be applied to the hot blow forming of any sheet material whose stretch forming properties in response to working gas pressure vary with temperature.

A sheet material is selected for forming into a specific part on suitable hot blow forming tooling. The selection of the material includes the composition, outline shape, and thickness of the blanks from which parts are to be successively formed on the tooling. A target forming temperature is identified coupled with a schedule for application of working gas pressure to gradually deform the blank into the desired shape of the part. The goal of this target temperature and time-pressure schedule is to rapidly form a commercially acceptable part. The target forming temperature is to be attained such as by heating the forming tools and preheating the blank material. However, as described above, it is sometimes difficult or impractical to manage the actual sheet material temperature at the target level during hour to hour, day to day forming operations. This invention uses predetermined temperature/formability properties of the sheet material to control the application of working gas pressure when the actual forming temperature deviates from the target temperature.

If suitable strain rate data is not available for the sheet material it can be experimentally obtained as a function of working gas pressure levels and operative forming temperature levels. Since blow forming often involves using a working gas to push and stretch the hot sheet into a concave surface, suitable strain data can usually be obtained from dome height measurements obtained by stretching a series of heated flat square sheet specimens, gripped at their four edges, toward a hemispherical cup shape at varying temperatures and pressures over timed intervals.

As an example, 1.2 mm thick sheet specimens of a fine grained, highly formable AA5083 alloy containing, by weight, 4.5% magnesium, 0.73% manganese, 0.21% iron, less than 0.2% silicon, 0.03% copper, 0.08% chromium and the balance aluminum were subjected to such bulge tests. Strain rate data were obtained at specimen temperatures of 400° C., 425° C., 450° C., 475° C. and 500° C. at applied working gas pressures from 25 to 80 psig. Each specimen was stretched over a timed interval toward a dome shape. An average strain rate was determined from the dome height and the reduced thickness of the material at the pole. Ductility depended upon forming temperature and the strain rate depended upon both temperature and gas pressure. In this instance, the strain data at the test temperatures were compiled in the form of equations of strain rate ($s^{-1}$) versus pressure (psi), e.g., strain rate ($s^{-1}$)=$1.71\times10^{-9}$ $(P_{425})^{3.1766}$ (for straining at 425° C.) as plotted with like data in FIG. 3. Strain data of this nature is used in the blow forming control process of this invention.

Preferably, the sheet metal hot blow forming operation is performed on tooling facilitating control of the temperature of the forming environment. The complementary forming tools are suitably fixed to platens of a press in which the tools are moved from an open position for insertion of a preheated workpiece to a closed position in which edges of the sheet material blank are gripped between the tools. One tool provides the forming surface opposite one side of the sheet and the other tool defines a chamber on the opposite side of the sheet for controlled application of pressurized working gas. It is preferred that the tools be independently internally heated and insulated for better temperature control of the forming operation. The practice of the method of this invention benefits from sensing and use of the operative temperature of the blank being formed to determine the optimal gas pressure for rapid, but defect free shaping of the part.

Thermocouples or other suitable sensing devices may be used in the bodies of the respective tools for control of their temperature. And a temperature sensor is used at or near the part forming surface of a tool for controlling the application of working gas pressure during the blow forming of the part. Thus data from a suitably located temperature sensor is continually supplied to a gas pressure controller during the blow forming of the sheet material. In the repetitive hot blow forming of preheated sheet material blanks into specific product shapes, the measured forming temperature is continually compared with the target temperature. Adjustments are made to the pressure of the working gas to obtain the desired shape changes in the sheet material at its actual forming temperature.

In the example of an AA5083 automotive body panel, the shape of the original flat blank sheet typically evolves from one of a few compound but large radii at relatively low gas pressure to a final product shape that includes many small radii at local positions achieved at a higher final gas pressure. The forming of this specific aluminum alloy sheet is desirably accomplished in the order of one to two minutes or so. However, the actual flow rate (shape evolution) and ductility of a sheet material processed in accordance with this invention depends significantly on the actual temperature of the sheet material during the forming process. Hence if the sheet material is stretched or blown at a target time-pressure schedule while experiencing a temperature different than the target temperature, the shape evolution will vary from the target sequence. In hot blow forming of AA5083 sheet metal, the desired or target temperature of the tools and workpiece might, for example; be 450° C., but in forming operations at this temperature level and with continual opening and closing of the tools to ambient conditions there can be forming temperature variations of several degrees that affect the formability of the workpiece.

This invention is a closed loop control process that changes the applied pressure-time cycle to account for changes in temperature affecting the shape change of the workpiece. A location is identified, for example at the forming tool surface, for temperature monitoring for the purpose of suitably controlling forming pressure for shape change of the workpiece. The goal of the process is to adjust and control working gas pressure to maintain a desired evolution of part shape so that the fastest possible gas pressurization cycle is maintained that does not damage the sheet material.

As stated, the practice of the invention is illustrated with respect to the hot blow forming of aluminum sheet metal alloys but the invention is applicable to the stretch forming of other sheet materials.

Other objects and advantages of the invention will be apparent from a detailed description of preferred embodiments of the invention which follows.

DESCRIPTION OF PREFERRED EMBODIMENTS

Figure 1:
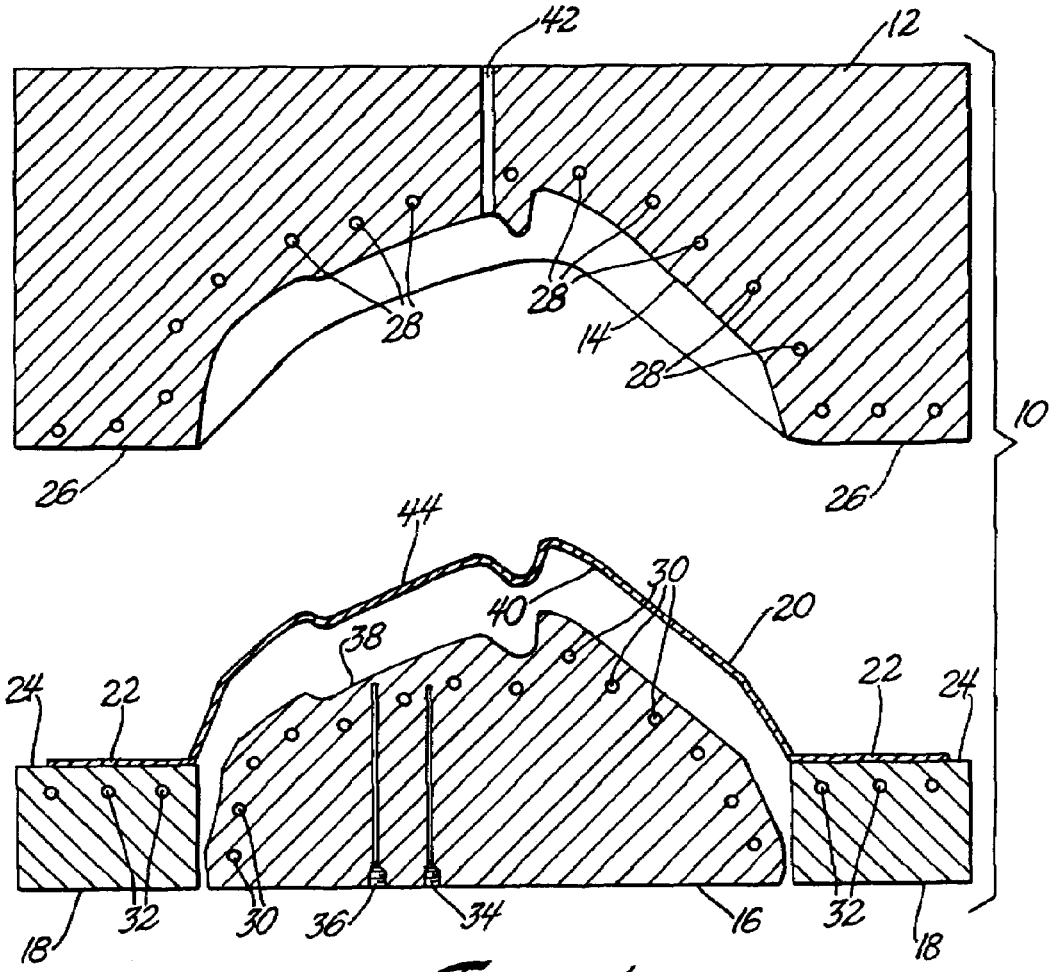
FIG. 1 is an elevation view in cross-section of an opposing pair of individually heated forming tools for the hot blow forming of an aluminum sheet metal alloy in accordance with this invention.

This invention is applicable to manufacturing operations in which substantially identical blanks of a sheet material are to be formed into like blow formed products, using a pressurized working gas, on a heated forming tool(s) in a suitable press or mold apparatus. FIG. 1 illustrates heated tooling for the two-stage forming of a preheated blank of very ductile aluminum alloy sheet material into a stretch formed panel. An example of the full two-stage forming of an aluminum alloy sheet material into a formed part will be described. The practice of the subject invention will be illustrated as the method is used during the second stage of the forming of the sheet metal part. However, it is to be understood that the method may be used in single stage hot blow forming processes as well as in either or both stages of a two-stage process.

FIG. 1 is a side elevation view, in cross-section, of tooling 10 for the hot blow forming of an automobile body panel using a sheet blank of AA5083 alloy. The tooling includes upper tool 12 with a concave cavity surface 14, lower tool 16 with a partly convex or punch forming surface 38, and binder ring 18 with sheet material engaging surface 24. Each of tools 12 and 16 and binder ring 18 are suitably formed of steel. Upper tool 12 is supported in a fixed position by the upper platen of a press (not shown). Lower tool 16 is supported on a base platen (not shown) of the press for movement from a lower, press open position as illustrated in FIG. 1 to a press closed position in close proximity to upper tool 12. Binder ring 18 is also supported by the press for upward movement independent of the press movement of lower tool 16.

In FIG. 1, the sheet material 20 is also shown in cross-section. In this example, the sheet material is a cold rolled and recrystallized sheet of a highly formable (superplastic) AA5083 alloy that is nominally 1.2 mm thick. Sheet material 20 is illustrated in its formed part shape ready for removal from surface 24 of binder ring 18. Sheet material 20 is initially in the form of a flat blank cut to a suitable outline shape for the forming of the part with minimal offal. The sheet material, in such blank form, is preheated by means not shown to a target temperature of, e.g., 475° C. After a previous formed part has been removed from the open press, the preheated sheet material is inserted between upper tool 12 and lower tool 16 and binder ring 18 in the press open position.

Binder ring 18 is raised to engage edges 22 of sheet material 20 at binder ring upper surfaces 24 and to clamp sheet material edges 22 against edge surfaces 26 of upper tool 12. Sheet material 20 in its blank form (not illustrated) is thus supported so that it underlies concave cavity forming surface 14 of upper tool 12. Binder ring 18 surrounds lower tool 16 with its punch surface 38. Lower tool 16 is raised within binder ring 18 to accommodate two-stage forming of sheet material 20 as will be described.

Upper tool 12 is formed of steel with machined cavity surface 14. Concave cavity surface 14 is used for the blow forming of sheet material 20 into a preform shape, not shown, but as defined by the shape of cavity 14. Upper tool 12 contains a plurality of electrical resistance heating rods 28. Electrical resistance heating rods 28 are connected to an electrical heating wiring system (not shown) which is adapted to control the heating of upper tool 12 to a desired temperature region, for example 475° C., for stretch forming of sheet material 20. But a forming tool such as upper tool 12 is often large and difficult to maintain at a precise target temperature above ambient temperature even with a sophisticated heating control system.

Lower tool 16 also contains several electrical resistance heating rods 30 and binder ring 18 has heating rods 32 for the same purpose. The electrical resistance heating systems for lower tool 16 and binder ring 18 are preferably controlled independently of each other and upper tool 12 so that each tool can be maintained close to a slightly different temperature target, if desired. Also outer surfaces of upper tool 12, lower tool 16 and binder ring 18 are provided with suitable high temperature insulation (not shown), to better maintain these tools close to their respective body temperatures and to prevent heat damage to other equipment in the vicinity of the press and forming operation.

In the two-stage, hot blow forming process for which the tooling combination 10 was designed, sheet material 20 is first preformed against cavity surface 14 of upper tool 12. In the example, sheet material 20 is a preheated substantially flat AA5083 blank inserted into an open press between open tools 12, 16 and 18. The tools, but not the sheet material, are positioned as shown in FIG. 1. The hot binder ring 18 is then raised so that the four side edge portions 22 of the sheet material 20 in blank form are gripped between binder ring surfaces 24 and upper tool side surfaces 26. Lower tool 16 is also raised close to, but not touching, the bottom surface 40 of the sheet material 20. The tools are each heated to affect blow forming of the sheet material close to a target or reference temperature of, e.g., 475° C. to stretch the sheet material into conformance with preform cavity surface 14.

Gas pressure (suitably air) is then applied to the lower side 40 of the hot sheet material 20 in its blank form to stretch it upwardly against the heated preform surface 14 of upper tool 12. Heated lower tool 16 does not contact the lower side 40 of the sheet material during this preform stage of blow forming but does contribute heat to the forming environment. Air under controlled pressure is admitted through a port, not shown, through binder ring 18 from a compressed air source, not shown. Lower tool 16 and binder ring 18 cooperate to define an air chamber behind surface 40 of the sheet material 20. The air pressure is increased incrementally over a period of, for example, 60 to 90 seconds from ambient pressure to a final preform pressure of less than 200 psi.

In the preforming of sheet material 20 against surface 14 of upper tool 12 rather large curves with large radii are initially formed and the general shape of the vehicle body panel or other sheet metal part is created in the sheet material. Thus, in the first stage of a two-stage hot blow forming process a goal of the preform step is to complete a substantial portion of the total required deformation in preparation for the creation of the final shaping of the part. It is in the second stage of forming in which the sheet material 20 is stretched against surface 38 of punch 16 that the sharper corners and finish radii are stretch formed in the sheet material 20.

At the completion of the preforming step, the preformed sheet material lies against cavity surface 14 of upper tool 12. Gas pressure is vented from the lower side 40 of the preformed sheet material through a vent line, not shown. The edges 22 of the sheet material 20 are still gripped between surfaces 26 of upper tool 12 and surfaces 24 of binder ring 18. Lower tool 16 is brought to a position near, but below, lower surface 40 of sheet material 20. Pressurized air is then admitted through working gas line 42 in upper tool 12 to push the upper surface 44 of sheet material 20 from heated preform surface 14. The pressure of the air admitted through gas line 42 is gradually increased from ambient pressure as will be described to push and stretch the hot preformed sheet material 20 into conformance with heated surface 38 of punch 16.

By way of example, the sheet material 20 in its initial blank form may have been preheated to a temperature of about 475° C. The upper tool 12 may be maintained at a preforming temperature of about 475° C. to facilitate the more rapid stretch forming of the sheet material into its preformed shape against surface 14. This higher temperature of the preformed tool 12 may permit the use of lower gas pressure and a shorter preforming cycle in the initial forming of the sheet material. But the critical final shape forming of the body panel is then accomplished against surface 38 of punch 16. It may be desired to maintain the lower tool 16 at a predetermined nominal temperature of 450° C. This lower forming tool temperature facilitates reasonably rapid forming of the sheet material from its preformed shape to its finished shape as illustrated in cross-section in FIG. 1, and also is a low enough temperature to facilitate removal of the sheet material from surface 38 of punch 16.

As stated, it is preferred that each of upper tool 12, lower tool 16 and binder ring 18 be individually heated and insulated for temperature control of each stage of the forming steps. Still, variations in the press operating conditions, cooling water supply, or malfunction of portions of the tool heating system could result in the exact temperature at the forming surface 38 of lower tool 16 varying away from the target of 450° C. despite the temperature control functions of lower tool body thermocouple 34 and the electrical control system activating heating rods 30 in lower tool 16. Thus, in this example, a second thermocouple 36 is positioned close to punch surface 38 of lower tool 16 for the purpose of measuring its temperature because the preformed sheet is close to it and will be shaped against it. Any difference between the temperature measured by thermocouple 36 and the pre-determined reference temperature is used to modify the pre-determined working gas pressure schedule for the final forming of sheet material 20 into the part configuration shown in FIG. 1.

Figure 4:
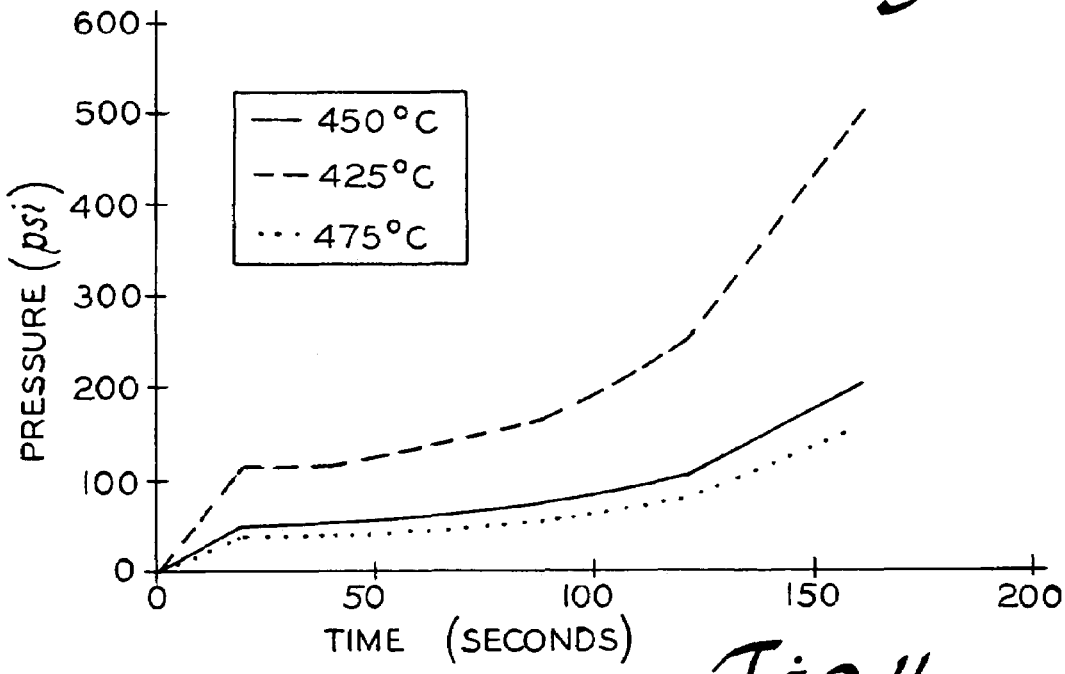
FIG. 4 is a graph of equivalent gas pressurization cycles to obtain similar strain rates when deforming AA5083 sheet specimens at 425° C., 450° C. and 475° C., respectively.

FIG. 4 is a graph of three equivalent working gas pressure/time plots at forming temperatures of 425° C. (dashed line), 450° C. (solid line) and 475° C. (dotted line). These pressure/time plots are experimentally determined for the hot blow forming of 1.2 mm thick AA5083 sheet material at equivalent strain rates at the respective temperatures. Thus, in the forming of the sheet material at a desired strain rate for a particular part shape, different pressure schedules may be employed at different temperatures. Assuming that the actual temperature of the sheet material blank is 450° C., a pressure application sequence as illustrated in FIG. 4 is used to shape the part at the desired strain rate. As seen by following the solid line in FIG. 4, the air pressure is first increased from ambient pressure to about 40 psi over a period of 20 seconds. The pressure is then further increased gradually to about 100 psi until a total of about 120 seconds has elapsed. The working gas pressure is increased up to about 200 psi during the final 40 seconds of the forming operation. However, if the effective forming temperature of the sheet metal is higher, for example 475° C., the working gas pressure is to be applied and increased in lower increments to achieve the same strain rate in the sheet material as shown by the dotted line in FIG. 4. Likewise, if the temperature is lower, for example, 425° C., as shown by the dashed line in FIG. 4, higher pressure increments are required to achieve substantially the same strain rate in the sheet material. This is the principle of operation of the subject process. Experiments are conducted with the sheet material to obtain pressure/time forming data at applicable forming temperatures like those illustrated in FIG. 4.

Figure 2:
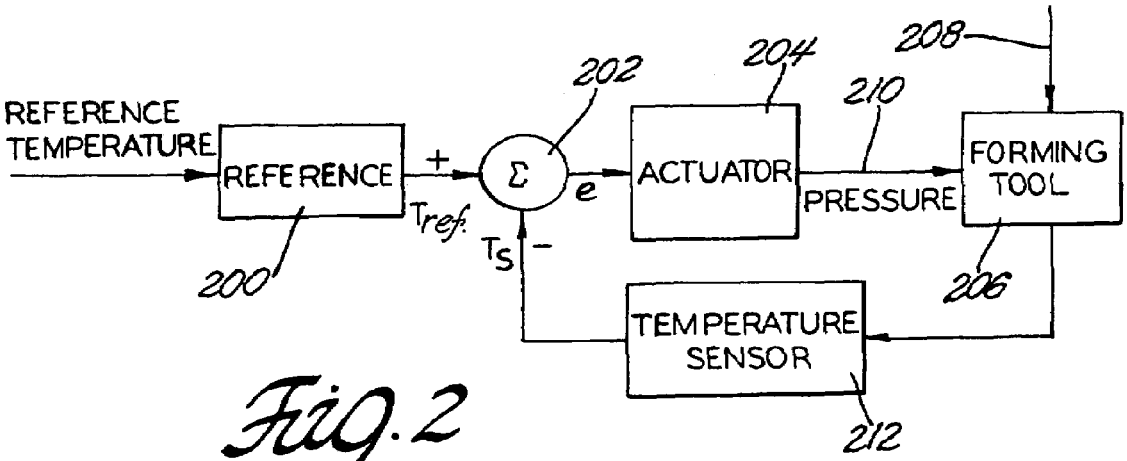
FIG. 2 is a schematic flow diagram of a process of controlling working gas forming pressure in response to measured temperatures at the surface of the forming tool of FIG. 1.

FIG. 2 diagrammatically illustrates a control process for the application of working gas pressure in the hot blow forming of a sheet material. For example, the control process would be used to control the admission of a working gas through gas line 42 in upper tool 12 to act on upper surface 44 of sheet material 20 in the finish forming sequence of this two-stage hot blow forming operation of an automobile body panel or the like. As stated, a predetermined schedule for forming gas pressure application, like the 450° C. solid line pressure/time schedule of FIG. 4, has been developed. But in accordance with this invention, the application of gas pressure during second stage forming of sheet material 20 is to be controlled in accordance with a measured temperature at a practical location affecting the final development of the shape of the part.

Referring to FIG. 2, heat is being applied (indicated at line 208) to forming tool, block 206, as necessary to raise its temperature to the predetermined reference temperature. Although there is a net heat input to forming tool, block 206, as indicated by the arrow direction on line 208 there is some heat loss and the temperature of the tool affecting the forming properties of a sheet material is not necessarily at a pre-determined reference temperature. Temperature sensor, block 212, obtains actual forming temperature data from the forming tool, block 206, for use by a numerical control device receiving temperature data from sensor, block 212. The control device is not illustrated in FIG. 2 but receives actual temperature data from sensor, block 212, for comparison with a predetermined reference temperature, block 200, in a comparator, block 202, in the control device. As indicated in this schematic diagram, the comparator determines if there is a resulting temperature difference, $e=T_{reference}-T_{sensor}$, that is to be used in adjusting the working gas pressure from the predetermined pressure/time schedule. The sensed temperature is subtracted from the reference temperature in this example. If the difference exceeds a predetermined number of degrees, for example fifteen Celsius degrees, an adjustment will be made in the forming pressure to compensate for the temperature difference.

Such a pressure control device is pre-programmed with the desired forming temperature and corresponding working gas pressure/time schedule for the hot blow forming of the sheet material. The controller continually monitors the forming tool temperature, or the temperature at another selected location, and adjusts the current working gas pressure to a level for strain of the sheet material at the sensed temperature level. The adjustment is made providing the temperature difference exceeds a predetermined difference as stated above (e.g., 15 C. degrees). The pressure adjustment is made by stored pressure schedule data like that illustrated graphically in FIG. 4 for the sensed temperature. Of course the pressure change is appropriate for the current time in the forming cycle for each part. The controller continually issues signals to pressure actuator, block 204, for timely adjustment of the forming pressure to quickly and safely shape the sheet material.

The control system is stable to disturbances such as heat losses from the forming tool and normal heat cycling of the temperature control of the tool. Suitable computer control practices are known for this purpose. For example, a proportional/integral/derivative (PID) controller is preferred. But controllers based on physical models of pressure and temperature of the system can be used. Also controllers based on weighted recursive least squares type management of the temperature data can be used.

In the case of relatively large blow forming tooling as is used to shape AA5083 body panels, changes in forming temperature are not necessarily rapid. Therefore, in general, it will not be necessary to change a time/gas pressure cycle during the one to two minute period (for example) for shaping a single part. Rather changes in the time/pressure cycle are made after several parts are completed and a significant temperature change is detected at the tool surface or other selected temperature sensing location.

Figure 3:
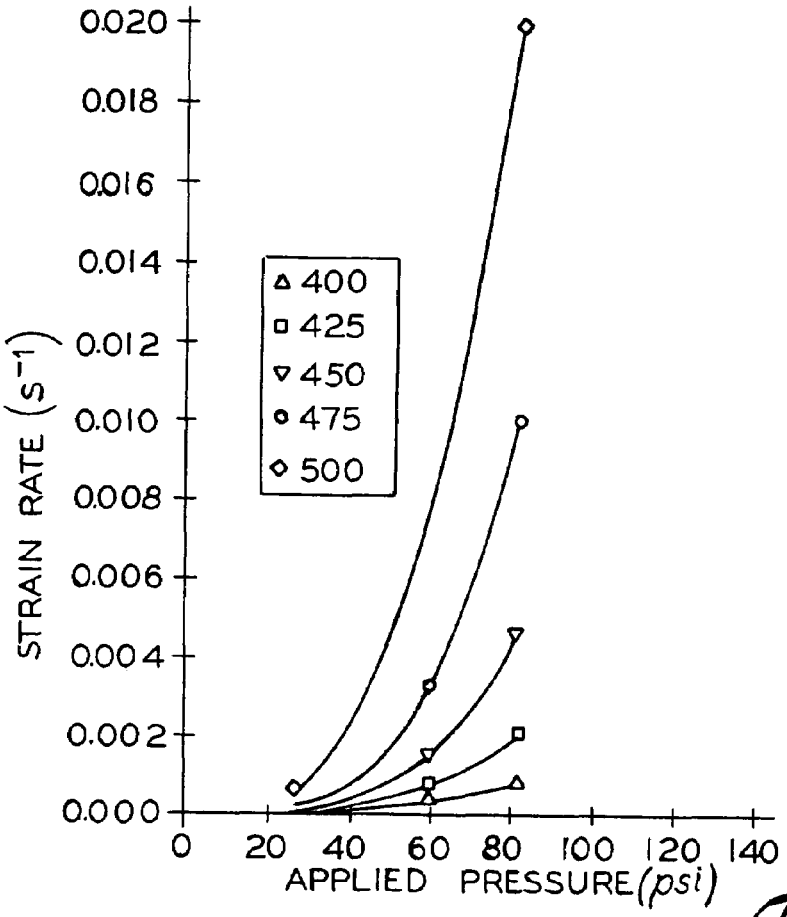
FIG. 3 is a graph of strain rates in hemispherical cup forming of AA5083 sheet metal specimens vs. applied working gas pressure at blow forming temperatures in 25 degree C. increments from 400° C. to 500° C.

In addition to pressure/time schedule data at varying times, like that illustrated in FIG. 4, the pressure controller can calculate relative sheet material strain rates as a function of temperature and pressure as suggested by data presented for AA5083 sheet material in FIG. 3. The data may be obtained by a dome or bulge forming test like those described above with the results as illustrated in FIG. 3. Each AA5083 sheet specimen was held at a uniform temperature and stretched toward a hemispherical shape at a constant applied pressure until the sheet failed or was strained to the extent possible by the applied gas pressure. An average strain rate was estimated over the time interval based on the thinning of the material in the pole region. This experiment was repeated at increased pressure levels to obtain strain rate forming curves with increased pressure at constant temperature as illustrated in FIG. 3.

In FIG. 3, the strain rate data with increased applied pressure over a range from about 25 psi to 80 psi are shown respectively at temperatures of 400° C., 425° C., 450° C., 475° C. and 500° C. This data was then converted to algebraic power law equation which can be used as a numerical basis in a control process for the hot blow forming of, a sheet material like AA5083:

Strain rate $(s^{-1})=3.64\times10^{-9}(P_{400})^{2.8026}$ (for strain at 400° C.);

Strain rate $(s^{-1})=1.71\times10^{-9}(P_{425})^{3.1766}$;

Strain rate $(s^{-1})=8.83\times10^{-10}(P_{450})^{3.5100}$;

Strain rate $(s^{-1})=1.62\times10^{-9}(P_{475})^{3.5461}$;

Strain rate $(s^{-1})=3.30\times10^{-8}(P_{500})^{3.0204}$, where P is the gas pressure in psi.

These power law data fits are a reasonable representation of the strain data for the AA5083 samples within the pressure range of 40–100 psi. For any strain rate, these data allow equivalent pressures to be determined for the operative measured forming temperature and the reference temperature. Where the equations are applicable they can be used to replicate strain rate behavior and part shape evolution over time for a panel to be shaped at a higher or lower temperature than the reference temperature.

The practice of this invention allows knowledge of the actual temperature of the sheet material, or of a forming surface or region closely affecting the shaping of the sheet material, to be used in determining the working gas pressure applied in the forming of the sheet material into a finished part. The desired strain rates are those which will form the part at the measured temperature most rapidly and efficiently without introducing tears or ripples or other defects in the part. Working gas pressure is adjusted based on the actual forming temperature to achieve the desired strain rate.

While this process has been illustrated with respect to AA5083 alloys, the method can be adapted to any sheet metal material and indeed any thermoplastic synthetic resin material. The time-working gas pressure-temperature-strain rate properties of the sheet material of a given thickness are determined experimentally and employed in a useful form such as the formability curves illustrated with respect to AA5083 in FIGS. 3 and 4. The strategy is to determine a target temperature for forming the sheet material and a time/pressure schedule for efficient and suitable shape evolution of the part by hot blow forming. The experimental data is used to establish different time/pressure schedules to obtain a like shape evolution of the part at suitable forming temperatures different from the target temperature.

Accordingly, while the invention has been described in terms of specific illustrative embodiments it is apparent that other embodiments of the invention could readily be adapted by those skilled in the art.

The invention claimed is:

1. A method of controlling application of a pressurized working gas against one side of a sheet material workpiece to stretch it into conformance with a heated forming surface as a succession of said workpieces are stretched into conformance with said forming surface, said method comprising:

predetermining working gas pressure relationships for stretch forming strain rates over a range of temperatures for said forming of said sheet material workpieces into a desired product shape;

predetermining a forming time-gas pressure application reference schedule at a reference forming temperature for said forming of said product shape; and during the forming of said sheet material workpieces;

continually measuring the temperature at a location selected for controlling the application of gas pressure for forming said sheet material workpieces; and adjusting the pressure of the working gas applied against said workpiece using a said pro-determined working gas pressure relationship for the measured temperature when said measured temperature differs from said reference forming temperature.

2. The method as recited in claim 1 in which said sheet material is a metal alloy.

3. The method as recited in claim 1 in which said sheet material is a thermoplastic polymeric material.

4. The method as recited in claim 1 comprising continually measuring the temperature at said heated forming surface for controlling the application of gas pressure for forming said sheet material workpieces.

5. The method as recited in claim 1 in which said pre-determined forming time-pressure application reference schedule comprises increasing said gas forming pressure in step-wise increments with increasing forming time increments from ambient pressure to a final forming pressure.

6. The method as recited in claim 5 comprising adjusting said gas pressure at said forming time increments in response to differences between said measured temperature and said reference forming temperature.

7. The method as recited in claim 1 in which said material is an aluminum sheet metal alloy and said pre-determined stretch forming strain rates are correlated as power law functions of gas forming pressure at said temperatures.

8. A method of controlling the forming of a heated aluminum sheet metal alloy workpiece during application of a pressurized working gas against one side of the heated sheet metal workpiece to stretch it against a heated forming surface as a succession of said workpieces are stretched into conformance with said forming surface, said method comprising:

predetermining working gas pressure relationships for stretch forming strain rates over a range of temperatures for said forming of said sheet metal workpieces into a desired product shape;

predetermining a forming time-gas pressure application reference schedule at a reference forming temperature for said forming of said product shape; and during the forming of said sheet metal workpieces;

continually measuring the temperature at a location selected for controlling the application of gas pressure for forming said sheet metal workpieces; and adjusting the pressure of the working gas applied against said workpiece using a said pre-determined working gas pressure relationship for the measured temperature when said measured temperature differs from said reference forming temperature.

9. The method as recited in claim 8 comprising continually measuring the temperature at said heated forming surface for controlling the application of gas pressure for forming said sheet metal workpieces.

10. A method of hot blow forming a superplastic aluminum sheet metal alloy workpiece using a pressurized working gas to stretch said workpiece against a forming surface of a heated forming tool into a product shape as a succession of said workpieces are stretched against said forming surface, said method comprising:

pre-heating said workpieces to a temperature in the range of 400° C. to about 500° C.;

predetermining a forming time-gas pressure application reference schedule at a reference forming temperature of said forming surface in the range of 400° C. to about 500° C. for said forming of said product shape; and during the forming of said workpieces;

using an electrical control circuit, and electrical resistance heaters in said forming tool, to heat said forming tool to said reference forming temperature;

continually measuring the temperature at said forming surface and comparing the measured temperature with the corresponding reference temperature; and adjusting the pressure of the working gas applied against said workpiece using a said pre-determined working gas pressure relationship for the measured temperature when said measured temperature differs from said reference forming temperature.

* * * * *